US006463915B2

(12) United States Patent
Ozaki et al.

(10) Patent No.: US 6,463,915 B2
(45) Date of Patent: Oct. 15, 2002

(54) EVAPORATIVE EMISSION CONTROL APPARATUS FOR MOTOR VEHICLE

(75) Inventors: Katsunori Ozaki, Kanagawa-ken (JP); Yuji Itakura, Buckinghamshire (GB)

(73) Assignee: Nissan Motor Co., Ltd., Yokohama (JP)

( * ) Notice: Subject to any disclaimer, the term of this patent is extended or adjusted under 35 U.S.C. 154(b) by 13 days.

(21) Appl. No.: 09/734,566

(22) Filed: Dec. 13, 2000

(65) Prior Publication Data

US 2001/0029932 A1 Oct. 18, 2001

(30) Foreign Application Priority Data

Dec. 15, 1999 (JP) ..... 11-356622

(51) Int. Cl.[7] ..... F02M 25/08
(52) U.S. Cl. ..... 123/519; 137/565.17
(58) Field of Search ..... 123/518, 519, 123/520; 137/565.17

(56) References Cited

U.S. PATENT DOCUMENTS 4,852,761 A * 8/1989 Turner et al. ..... 123/519 X
6,182,693 B1 * 2/2001 Stack et al. ..... 123/519 X
6,273,070 B1 * 8/2001 Arnal et al. ..... 123/519
6,302,144 B1 * 10/2001 Graham et al. ..... 123/514 X

FOREIGN PATENT DOCUMENTS

JP 64-347 1/1989

* cited by examiner

*Primary Examiner*—Tony M. Argenbright
(74) *Attorney, Agent, or Firm*—Foley & Lardner

(57) ABSTRACT

An evaporative emission control apparatus for a motor vehicle includes a fuel tank having a tank shell to store fuel therein, a canister disposed completely within the fuel tank to adsorb and temporarily store evaporative fuel generated in the fuel tank, and a bracket that is secured to the fuel tank to support the canister apart from the tank shell. The outer surface of the canister is set apart from the inner surface of the tank shell, so that the canister is less influenced by the environment temperature around the fuel tank, and so that the adsorption of the evaporative fuel is kept stable.

15 Claims, 2 Drawing Sheets

EVAPORATIVE EMISSION CONTROL APPARATUS FOR MOTOR VEHICLE

The contents of Japanese Patent Application No. 11-356622, with a filing date of Dec. 15, 1999, in Japan, is incorporated by reference herein, in its entirety.

BACKGROUND OF THE INVENTION

The present invention relates generally to an evaporative emission control apparatus for a motor vehicle, and more particularly to a supporting structure of a canister within a fuel tank.

A conventional evaporative emission control apparatus is provided with a canister that contains an adsorbent material made of activated charcoal, which is able to adsorb evaporative fuel. The canister adsorbs the evaporative fuel generated in the fuel tank. Then the canister is purged and supplies the evaporative fuel to an intake system of an internal combustion engine when it is in operation. In this way, the evaporative emission control apparatus reduces the evaporative fuel released into the atmosphere.

In the structure described above, since the canister is a component of a fuel supplying system of a motor vehicle, it is generally disposed in an engine compartment or under a floor panel of the vehicle body.

Recently, it has been recognized that the adsorbability of the adsorbent material depends on its temperature. Japanese Provisional Patent (Kokai) Publication No. 64-347 (1989) discloses a canister disposed in the fuel tank in order to improve the adsorbability of the adsorbent material by preventing the temperature thereof from changing as much as possible.

Specifically, it discloses the fuel tank having an opening on the upper shell thereof, and the canister inserted through the opening into the fuel tank. The top surface of the canister closes the opening as a lid.

The periphery of the top surface of the canister is fixed to the periphery of the opening by means of, for example, bolts and nuts, and sealing material, such as packing made of a synthetic resin, is provided between these peripheries.

In the prior art described above, although the canister is disposed in the fuel tank, the top surface of the canister closes the opening of the fuel tank as a lid, and, therefore, makes itself a part of the upper shell of the fuel tank. That is, it can be said that top surface of the canister is brought into direct and broad contact with the upper shell of the fuel tank.

SUMMARY OF THE INVENTION

If a surface of the canister is in direct and broad contact with a shell of the fuel tank, the canister can be easily affected by the environment temperature outside the fuel tank, which depends on an air temperature, heat radiation from an exhaust tube disposed near the fuel tank, and heated air from the engine compartment. The change of the environment temperature may cause the adsorption of the adsorbent material disposed in the canister to be unstable.

And recently, other than the sealing material such as packing, some other components of the fuel supplying system, such as a casing of the canister, evaporative fuel passages connected thereto, for example, are made of a synthetic resin. Therefore, the evaporative fuel (mostly comprising HC or hydrocarbon) may penetrate through the synthetic resin material of which packing or other components are made, although it may be a very small quantity.

Therefore when the top surface of the canister is used as a lid that closes the opening of the fuel tank as the prior art discloses, a small amount of the evaporative fuel may be released into the atmosphere by penetrating through the packing or other components made of a synthetic resin.

Since the need for reducing the evaporative fuel released into the atmosphere for improving the environmental protection is getting more important, there is a need to reduce the evaporative fuel released into the atmosphere as much as possible.

Therefore, a general object of the invention is to provide an improved evaporative emission control apparatus that alleviates one or more of the shortcomings discussed earlier herein.

An object of the invention is to provide an evaporative emission control apparatus that can provide stable adsorption of the evaporative fuel.

Another object of the invention is to provide an evaporative emission control apparatus that reduces the evaporative fuel released into the atmosphere, by penetrating through a synthetic resin material, as much as possible.

The above and other objects of the present invention can be accomplished by an evaporative emission control apparatus for a motor vehicle that includes a fuel tank having a tank shell to store fuel therein, a canister disposed within the fuel tank to adsorb and temporarily store evaporative fuel generated in the fuel tank, and a bracket that is secured to the fuel tank to support the canister apart from the tank shell.

According to one aspect of the present invention, the canister is disposed in the fuel tank by the bracket, and the outer surface of the canister is arranged apart from the inner surface of the tank shell. Therefore the canister is less influenced by the environment temperature around the fuel tank, and the adsorption of the evaporative fuel can be kept stable.

Furthermore, even if the outer surface of the canister is made of a synthetic resin, penetration of the evaporative fuel through the outer surface causes few problems because the entire canister is disposed within the fuel tank, and arranged apart from the inner side of the tank shell. Furthermore, the evaporative fuel cannot penetrate outside of the fuel tank between the peripheries of the opening on the tank shell and the top surface of the canister, as is the case in the prior art structures. Therefore the present invention reduces the evaporative fuel released into the atmosphere.

The evaporative emission control apparatus described above may further include a first connector that connects an evaporative fuel passage with the canister, and a supporting point where the canister is supported to the bracket. may be located proximate to the first connector.

According to the structure mentioned above, since the bracket reduces the movements of the canister around the supporting point, the bracket also reduces the moment around the first connector as much as possible. Therefore, the first connector maintains a firm connection to the evaporative fuel passage.

The evaporative emission control apparatus described above may further include a second connector that penetrates through the tank shell, and a securing point where the bracket is secured to the fuel tank may be located proximate to the second connector.

According to the structure mentioned above, the evaporative fuel passage connected to the canister and to the second connector can be made as short as possible, and occupies as little as possible of the inner space of the fuel tank. Therefore it makes it easier to arrange the evaporative fuel passage and other components in the fuel tank.

Furthermore, even if the evaporative fuel passage is made of a synthetic resin, a shorter passage makes its area through which the evaporative fuel can penetrate smaller, so that the evaporative fuel that penetrates through the evaporative fuel passage can be reduced, and the evaporative fuel released into the atmosphere can be reduced as much as possible.

When the canister is disposed within the fuel tank apart from the tank shell, the canister may be hung on an upper portion of the fuel tank by the bracket.

According to the structure mentioned above, since the second connector is generally located on the upper part of the fuel tank, the evaporative fuel passage connected to the canister and to the second connector can be made much shorter, and occupies less of the inner space of the fuel tank. Therefore it becomes much easier to arrange the evaporative fuel passage and other components in the fuel tank.

Furthermore, the bracket may be elastically deformable.

According to the structure mentioned above, a resilient portion is formed on the bracket, and it can absorb the load brought to the canister caused by vibrations of the vehicle and/or the inertial force of the canister at a time of acceleration or deceleration of the vehicle, so that the resilient portion can prevent the concentration of the load brought to the securing point, and the fuel tank can be protected effectively.

The bracket may also have an yielding portion between the securing point and the supporting point.

According to the structure mentioned above, the yielding portion can absorb the excessive load caused by a collision of the vehicle by a deformation and/or a rupture thereof. In the manner described above, the yielding portion can prevent the concentration of the load brought to the securing point, and the fuel tank can be protected more effectively.

The evaporative emission control apparatus of the present invention may further include a guide bracket disposed in the fuel tank to support a lower part of the canister and prevent horizontal movements thereof.

According to the structure mentioned above, the guide bracket supports the lower part of the canister against the load caused by vibrations of the vehicle and/or the inertial force of the canister at a time of acceleration or deceleration of the vehicle so that it can prevent horizontal movements of the canister, and thereby provide stable support.

The evaporative emission control apparatus of the present invention may further include a resilient support member to support the lower part of said canister and reduce vertical movements thereof.

According to the structure mentioned above, the resilient support member can reduce vertical movements of the canister caused by vibrations of the vehicle, so that it can lighten the load brought to the bracket to support the canister.

Further objects, features and advantages of the present invention will become apparent from the Detailed Description of Preferred Embodiments which follows when read in light of the accompanying figures and the claims.

DETAILED DESCRIPTION OF THE PREFERRED EMBODIMENTS

Hereinafter, preferred embodiment(s) of the present invention are described in detail with reference to the attached drawings.

Figure 1:
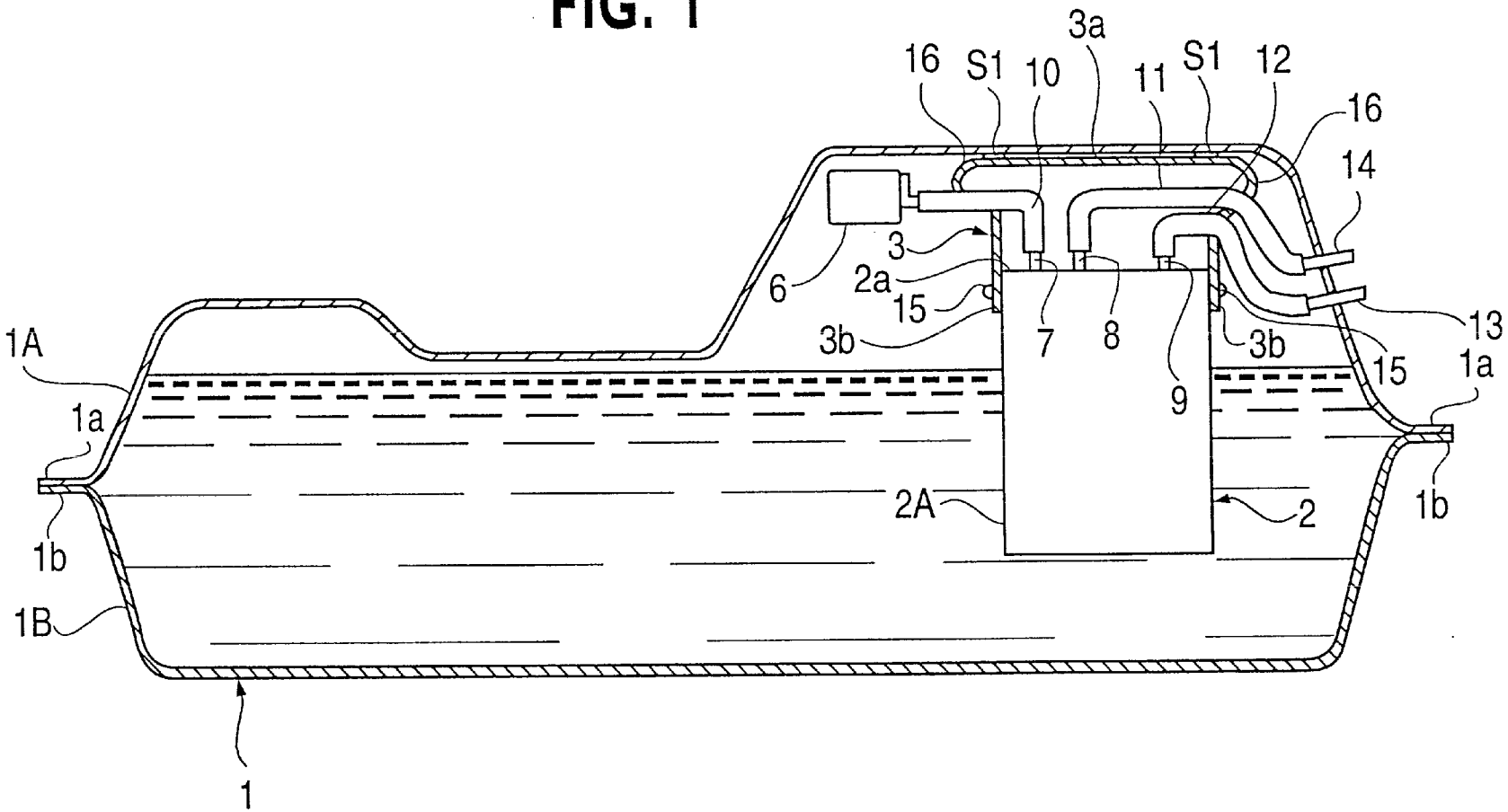
FIG. 1 is a cross sectional view of a fuel tank showing a structure of an evaporative emission control apparatus therein according to a first embodiment of the present invention.

FIG. 1 shows a structure of fuel tank unit to which an evaporative emission control apparatus of the present invention is applied as a first embodiment. The fuel tank unit comprises a fuel tank 1, and a canister 2 disposed completely within the fuel tank 1. The canister 2 adsorbs an evaporative fuel (mostly comprising HC or hydrocarbon) generated in the fuel tank 1 and temporarily stores it.

The fuel tank 1 has a tank shell (1A, 1B) that comprises an upper shell 1A and a lower shell 1B, and they are joined together at each peripheral flange portion (1*a*, 1*b*) respectively.

The canister 2 contains adsorbent material therein that can adsorb and temporarily store the evaporative fuel.

The canister 2 of this embodiment has first connectors (7, 8, 9) on one end (e.g., on the upper end surface 2*a* in FIG. 1) and the other end (e.g., bottom end surface in FIG. 1) is closed. The canister of this type is called 'bottom-end type' canister. The first connectors (7, 8, 9) mentioned above include an evaporation connector 7, a purge connector 8, and a drain connector 9. The evaporation connector 7 is connected to an evaporation passage 10 that is further connected to an inner space of the fuel tank 1. A control valve 6 is provided on the evaporation passage 10 and controls gas-flow in the evaporation passage 10. The purge connector 8 is connected to a purge passage 11 that introduces the evaporative fuel adsorbed in the canister 2 into an intake system (not shown) of an internal combustion engine. The drain connector 9 is connected to a drain passage 12 that is open to the atmosphere. It should be understood that each of the evaporation passage 10, the purge passage 11, and the drain passage 12 is an example of evaporative fuel passages.

The canister 2 has a partition wall therein (not shown), between the drain connector 9 and other connectors (i.e. the evaporation connector 7 and the purge connector 8), except in the bottom part of the canister 2. Therefore the evaporative fuel is regulated to flow between the drain connector 9 and the other connectors (7, 8) through the bottom part of the canister 2. The canister 2 of such type is called 'U-turn flow type' canister.

The canister 2 has a casing 2A that forms an outer surface. The casing 2A is made, preferably, of a synthetic resin, disposed in the fuel tank and supported thereto by a bracket 3, and is arranged apart from the inner surface of the tank shell 1A.

Specifically in this first embodiment, the upper portion 3*a* of the bracket 3 is secured (by welding, for example) to an upper and inner surface of the tank shell 1A at securing points (S1, S1), so that the bracket 3 hangs the canister 2 on the fuel tank 1.

Second connectors (13, 14) are disposed on the upper shell 1A of the fuel tank 1. These are provided on the drain passage 12 and the purge passage 11, respectively, so that these passages (11, 12) penetrate through the tank shell 1A using the second connectors (13, 14). Since the bracket 3 and the second connectors (13, 14) are disposed on the upper shell 1A, all of these are located in upper half of the fuel tank 1. Also, as shown in FIG. 1, the bracket 3 is located in a right half of the fuel tank 1 where the second connectors (13, 14) are disposed. Since the securing points (S1, S1) are located at a distance that is less than one half of the length of the fuel tank 1 from the second connectors (13, 14) in a horizontal direction, and at a distance that is less than one half of the height of the fuel tank in the vertical direction, the securing points (S1, S1) of the bracket 3 are located proximate to the second connectors (13, 14).

On the other hand, the lower end portions (3*b*, 3*b*) of the bracket 3 are attached to an upper side surface of the canister 2 by rivets (15, 15). Since the lower ends of the bracket 3 support the canister 2 at supporting points that is located in a half part of the canister 2 where the first connectors (7, 8, 9) are disposed (i.e., an upper half part of the canister 2), the supporting points on the bracket 3 are located proximate to the evaporation connector 7, the purge connector 8, and the drain connector 9, as shown in FIG. 1.

The bracket 3 is, preferably, formed to be curved at curvature portions (16, 16). The curvature portions (16, 16) have a thickness thinner than the other portions of the bracket 3, with maintaining sufficient strength to support the canister 2, and by their shape and thickness, they perform as: (i) resilient portions to absorb the load brought to the canister 2 caused by vibrations of the vehicle and/or the inertial force of the canister 2 at a time of acceleration or deceleration of the vehicle, and (ii) yielding portions to absorb an excessive load caused by a collision of the vehicle by a deformation and/or a rupture thereof.

The resilient portions and the yielding portions may alternatively be made only by the curvature portions, or only by having thickness thinner than the other portions of the bracket 3, or by a combination thereof.

According to the first embodiment described above, the canister 2 is disposed in the fuel tank 1 by the bracket 3, and the outer surface of the canister 2 is arranged apart from the inner surface of the tank shell 1A. Therefore the canister 2 is less influenced by the environment temperature around the fuel tank 1, and the stable adsorption of the evaporative fuel is achieved.

Furthermore, although the outer surface (i.e. casing 2A) of the canister 2 is made of the synthetic resin, penetration of the evaporative fuel through the casing 2A causes few problems because the entire canister 2 is disposed within the fuel tank 2, and apart from the inner surface of the tank shell 1A. Because there is no need to dispose a sealing material between the opening of the fuel tank and the top surface of the canister, as required in the prior art, the evaporative fuel cannot penetrate outside the fuel tank 1. Thus, the present invention reduces the evaporative fuel released into the atmosphere.

According to one aspect of the present invention, the synthetic resin material having anti-penetration characteristics of fuel is not needed for the sealing material of the first connectors (7, 8, 9) and the casing 2A of the canister 2 because these are entirely disposed within the fuel tank 1. Therefore, it is cost effective because the synthetic resin material with such special characteristics, as mentioned above, is not required in the fuel tank 1.

In the first embodiment, in addition to the result mentioned above, since the bracket 3 supports the canister 2 at supporting points proximate to the first connectors disposed on the upper end surface 2*a* of the canister 2 (i.e. the evaporation connector 7, the purge connector 8, the drain connector 9), and since the bracket 3 reduces the movements of the canister 2 around the supporting points, the bracket 3 reduces the moment around the first connectors (7, 8, 9). Therefore, the connectors (7, 8, 9) maintain a firm connection to the evaporative fuel passages (10, 11, 12).

Since the bracket 3 is secured to the fuel tank 1 at the securing points (S1, S1) (on the upper portion 3*a* of the bracket 3) proximate to the second connectors (13, 14) that penetrate through the tank shell 1A, the evaporative fuel passages connected to the canister 2 and to the second connectors (13, 14) (i.e. the drain passage 12, the purge passage 11, respectively) are provided as short as possible, and occupy as little as possible of the inner space of the fuel tank 1, so that it becomes easy to arrange these passages and other components in the fuel tank 1.

Furthermore, since the passages (11, 12) are made of a synthetic resin, shorter passages (11, 12) make their areas through which the evaporative fuel penetrates smaller, so that the evaporative fuel that penetrate through the passages (11, 12) is reduced, and the evaporative fuel released into the atmosphere is reduced.

As described above, the canister 2 is hung on the upper portion of the fuel tank 1 by the bracket 3, and the second connectors (13, 14) are generally located on the upper part of the fuel tank 1. Therefore the passages connected to the canister 2 and to the second connectors (13, 14) of the fuel tank 1 are provided to be much shorter, and occupy much less of the inner space of the fuel tank 1, and it becomes much easier to arrange these evaporative fuel passages and other components in the fuel tank 1.

According to the first embodiment, there is provided the curvature portion 16 between the securing point (i.e. the upper portion 3*a*) and the supporting point (i.e. the lower end portion 3*b*). The curvature potion 16 performs not only as a resilient portion to absorb the load brought to the canister 2 caused by vibrations of the vehicle and/or the inertial force of the canister 2 at the time of acceleration or deceleration of the vehicle, but also as a yielding portion to absorb the excessive load caused by a collision of the vehicle by a deformation and/or a rupture thereof. In the manner described above, the curvature portion 16 prevents the concentration of the load to the securing point, therefore the fuel tank 2 is protected effectively.

Figure 2:
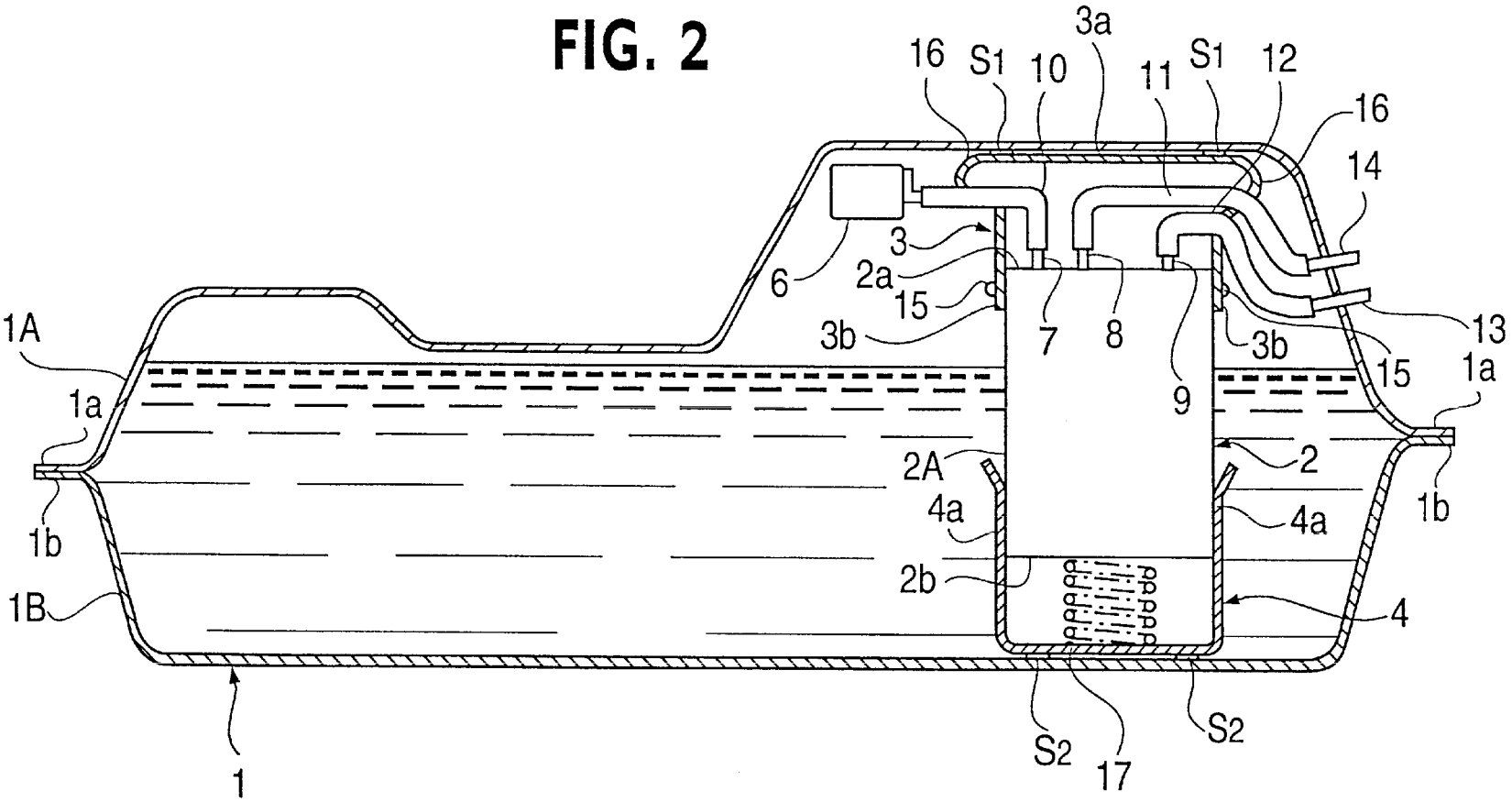
FIG. 2 is a cross sectional view of a fuel tank showing a structure of an evaporative emission control apparatus therein according to a second embodiment of the present invention.

FIG. 2 shows a second embodiment of the present invention. In this second embodiment, in addition to the features disclosed in the first embodiment, there is provided a guide bracket 4 that prevents horizontal movements of the canister 2 and a resilient support member 17 to support the bottom of the canister 2 and reduce vertical movements thereof.

The guide bracket 4 is disposed in the fuel tank 1 and the bottom of it is fixed to the inner and lower portion of the tank shell 1B by welding at the fixing points (S2, S2)

The guide bracket 4 is formed like a cup open at the top, and an upper end periphery (4*a*, 4*a*) of the guide bracket 4 is widened for the ease of inserting the canister 2 at the time of assembling.

A coil spring is provided under the canister 2 as the resilient support member 17.

In this second embodiment as shown in FIG. 2, the coil spring is located in the guide bracket 4 and supported on the bottom thereof so that it is supported on the lower surface of the tank shell 1B.

According to the second embodiment described above, in addition to the advantages of the first embodiment, the guide bracket 4 supports the lower part of the canister 2 against the load caused by the vibrations of the vehicle and/or the inertial force of the canister 2 at a time of acceleration of deceleration of the vehicle so that it prevents the horizontal movements of the canister 2, and provides stable support.

Furthermore, the coil spring as the resilient support member 17 reduces the vertical movements of the canister 2 caused by the vibrations of the vehicle, so that it lightens the load to the bracket 3 to support the canister 2.

Although the present invention has been described above by reference to certain embodiments of the invention, the invention is not limited to the embodiments described above. Modifications and variations of the embodiments described above will occur to those skilled in the art, in light of the above teachings, and these modifications and embodiments are considered to a part of the present invention.

For instances, there is provided the coil spring as the resilient support member 17 in the second embodiment, but the resilient support member is not limited to the coil spring, and any other material such as a synthetic resin with a desirable resilient characteristic may be used alternatively as the resilient support member as would be recognized by those skilled in the art.

In the first and second embodiment described above, the yielding portion is formed as the curvature portion 16 that is thinner than the other portion of the bracket 3 and it also performs as the resilient portion. Alternatively, the yielding portion may be made as a notch formed on the bracket 3 between the securing points and the supporting points.

Alternatively, the resilient portion of the bracket 3 may be made as a spring intermediately disposed on the bracket 3, or merely may be made of the resilient material.

Although the canisters 2 of these embodiments are disclosed as the 'bottom closed type' canister, any other type of canister may be employed, as would be recognized by those skilled in the art, and such modified embodiments can similarly have the results of the present invention described above.

The scope of the present invention is defined with reference to the following claims.

We claim:

1. An evaporative emission control apparatus for a motor vehicle comprising:

a fuel tank having a tank shell to store fuel therein;

a canister disposed completely within said fuel tank to adsorb and temporarily store evaporative fuel generated in said fuel tank;

a bracket that is secured to said fuel tank to support said canister apart from said tank shell; and a connector that penetrates through said tank shell, wherein a securing point where said bracket is secured to said fuel tank is located proximate to said connector.

2. An evaporative emission control apparatus for a motor vehicle comprising:

a fuel tank having a tank shell to store fuel therein;

a canister disposed completely within said fuel tank to adsorb and temporarily store evaporative fuel generated in said fuel tank; and a bracket that is secured to said fuel tank to support said canister apart from said tank shell, wherein said canister is hung on an upper portion of said fuel tank by said bracket, and wherein said bracket is elastically deformable.

3. The evaporative emission control apparatus as claimed in claim 2, wherein said bracket has a yielding portion between a securing point where said bracket is secured to said fuel tank and a supporting point where said bracket supports said canister.

4. The evaporative emission control apparatus as claimed in claim 2, further comprising a guide bracket disposed in said fuel tank to support a lower part of said canister and prevent horizontal movements thereof.

5. The evaporative emission control apparatus as claimed in claim 2, further comprising a resilient support member to support a lower part of said canister and reduce vertical movements thereof.

6. An evaporative emission control apparatus for a motor vehicle comprising:

a fuel tank having a tank shell to store fuel therein;

a canister disposed completely within said fuel tank to adsorb and temporarily store evaporative fuel generated in said fuel tank; and a bracket that is secured to said fuel tank to support said canister apart from said tank shell, wherein said bracket is elastically deformable.

7. The evaporative emission control apparatus as claimed in claim 6, wherein said bracket has a yielding portion between a securing point where said bracket is secured to said fuel tank and a supporting point where said bracket supports said canister.

8. The evaporative emission control apparatus as claimed in claim 6, further comprising a guide bracket disposed in said fuel tank to support a lower part of said canister and prevent horizontal movements thereof.

9. The evaporative emission control apparatus as claimed in claim 6, further comprising a resilient support member to support a lower part of said canister and reduce vertical movements thereof.

10. An evaporative emission control apparatus for a motor vehicle comprising:

a fuel tank having a tank shell to store fuel therein;

a canister disposed completely within said fuel tank to adsorb and temporarily store evaporative fuel generated in said fuel tank; and a bracket that is secured to said fuel tank to support said canister apart from said tank shell, wherein said bracket has a yielding portion between a securing point where said bracket is secured to said fuel tank and a supporting point where said bracket supports said canister.

11. The evaporative emission control apparatus as claimed in claim 10, further comprising a guide bracket disposed in said fuel tank to support a lower part of said canister and prevent horizontal movements thereof.

12. The evaporative emission control apparatus as claimed in claim 10, further comprising a resilient support member to support a lower part of said canister and reduce vertical movements thereof.

13. An evaporative emission control apparatus for a motor vehicle comprising:

a fuel tank having a tank shell to store fuel therein;

a canister disposed completely within said fuel tank to adsorb and temporarily store evaporative fuel generated in said fuel tank;

a bracket that is secured to said fuel tank to support said canister apart from said tank shell, and a guide bracket disposed in said fuel tank to support a lower part of said canister and prevent horizontal movements thereof.

14. The evaporative emission control apparatus as claimed in claim 13, further comprising a resilient support member to support a lower part of said canister and reduce vertical movements thereof.

15. An evaporative emission control apparatus for a motor vehicle comprising:

a fuel tank having a tank shell to store fuel therein;

a canister disposed completely within said fuel tank to adsorb and temporarily store evaporative fuel generated in said fuel tank; and a bracket that is secured to said fuel tank to support said canister apart from said tank shell, and a resilient support member to support a lower part of said canister and reduce vertical movements thereof.

* * * * *